US006725594B2

(12) United States Patent
Hines

(10) Patent No.: US 6,725,594 B2
(45) Date of Patent: Apr. 27, 2004

(54) RAIL COVER FOR FIREARM RAIL SYSTEMS

(76) Inventor: Stephen Charles Hines, P.O. Box 423, Tijeras, NM (US) 87059

( * ) Notice: Subject to any disclaimer, the term of this patent is extended or adjusted under 35 U.S.C. 154(b) by 0 days.

(21) Appl. No.: 10/288,354

(22) Filed: Nov. 4, 2002

(65) Prior Publication Data

US 2003/0106252 A1 Jun. 12, 2003

Related U.S. Application Data

(60) Provisional application No. 60/337,475, filed on Nov. 4, 2001.

(51) Int. Cl.[7] ..... F41G 1/38; F41A 35/02

(52) U.S. Cl. ..... 42/90; 42/96; 42/124; 42/128

(58) Field of Search ..... 42/90, 124, 148, 42/128, 127, 96, 143, 129, 112

(56) References Cited

U.S. PATENT DOCUMENTS

| | | | | | |
|---|---|---|---|---|---|
| 2,436,453 | A | * | 2/1948 | Schulz | 42/148 |
| 4,858,361 | A | | 8/1989 | White | |
| 4,934,085 | A | * | 6/1990 | Lough | 42/127 |
| 5,198,600 | A | | 3/1993 | E'Nama | |
| 5,279,060 | A | | 1/1994 | Watson | |
| 5,570,529 | A | | 11/1996 | Amelino | |
| 5,826,363 | A | | 10/1998 | Olson | |
| 5,878,503 | A | * | 3/1999 | Howe et al. | 42/132 |
| 5,941,489 | A | * | 8/1999 | Fanelli et al. | 248/298.1 |
| 6,014,830 | A | * | 1/2000 | Brown et al. | 42/145 |
| 6,418,657 | B1 | * | 7/2002 | Brown | 42/124 |
| 6,421,946 | B1 | * | 7/2002 | LoRocco | 42/111 |
| 6,446,377 | B1 | * | 9/2002 | Hollenbach et al. | 42/148 |
| 2001/0022044 | A1 | * | 9/2001 | Spinner | 42/124 |
| 2003/0074822 | A1 | * | 4/2003 | Faifer | 42/71.01 |

* cited by examiner

*Primary Examiner*—Charles T. Jordan
*Assistant Examiner*—John W. Zerr
(74) *Attorney, Agent, or Firm*—Geoffrey E. Dobbin

(57) ABSTRACT

The disclosed invention is a rail cover for use on mounting rails typically, though not exclusively, used on personal firearms. The covers may be made to fit either Picatinny or Weaver type rails and feature a clipping structure on the cover's underside that grasps the rail while the tension in the cover body holds the cover in place. Two preferred embodiments disclose a solid cover and a low profile, ribbed cover that nests within transverse grooves in some rails. Alternatively, a restraining beam may be utilized to further restrain the clipping structure and retain the cover on the rail.

30 Claims, 4 Drawing Sheets

RAIL COVER FOR FIREARM RAIL SYSTEMS

CROSS-REFERENCES TO RELATED APPLICATIONS

This application claims priority based on earlier filed provisional application 60/337,475, filed on Nov. 4, 2001.

FIELD OF THE INVENTION

The present invention relates to protective covers for rail systems used on firearms and more particularly related to covers that clip unto a rifle's support rail system.

BACKGROUND OF THE INVENTION

Many military, police and civilian firearms are equipped with rail configurations for mounting various accessories such as: optics, lights, vertical grips, lasers and others items. A military standard, M-1913, has even been established for a particular rail system known as the Picatinny Rail. Another type of rail, the Weaver style, is also in use. The existence and wide spread use of these rails is attested to in the prior art. When rail sections are not in use for mounting accessories they should be covered to prevent damage to the rail system. Covers according to the prior art, specifically depicted in U.S. Pat. No. 5,826,363 (1998), FIG. 29, (col. 5, line 60), tend to be made or a rigid polymer and slide over the rail system. These covers protect the rail system, but require a time consuming procedure when a user desires to mount an instrument on the rail. Typically, the covers must be secured on a dedicated end of the cover by a clipping mechanism that interfaces with only preset portions of the rail. Often times, the instrument, when mounted ideally, precludes additional mounting of covers for the rail, thereby leaving portions exposed, despite varying lengths of rail covers according to the prior art. The prior art covers are also known to become slippery when wet, thereby increasing the likelihood of mishandling the weapon in use or transportation.

The covers according to the present invention not only protect the rail system and can serve as the hand guard for the operator to hold onto while manipulating the weapons, but also feature targeted removal of covers and are modifiable so that more rail area may be protected. They also provide a positive, non-slip gripping surface for use when the weapon is wet.

SUMMARY OF THE INVENTION

In view of the foregoing disadvantages inherent in the known types of rail covers, this invention provides an improved rail cover. As such, the present invention's general purpose is to provide a new and improved rail cover that will be easily installed and removed, easily modified, inexpensive to produce, an provide a non-slip gripping surface for the user.

By using a standard size of grip and a clip-on design, much more versatility can be accomplished. For example, a 1.8" section of cover protects five slots in the rail and the related recoil abutments. A flexible material is selected for forming the covers. Examples could be synthetic rubber, polyurethane, silicone, neoprene etc., but not limited to these materials. In forming these covers they nest around the angular sections of the rail. Ribs can be formed in the covers that nest into one or more of the slot sections of the rail or ribs can be avoided for solid rails. These ribs perform several functions. First, they locate the cover on the rail not allowing it to move forward or backward. They also stiffen The cover to hold it in place and prevent it from coming off the rail. The cover can be installed by clipping it onto the rail and requires no special machined slot to lock the cover onto the rail. This type of cover also lends itself to having a full cover that gives a rounded gripping area, but of a large diameter for holding. In this type, ribs are made on the outside of the grip covers to aid in stiffening it and enhance the ergonomics of the gripping area. In another low profile configuration, the cover houses around the angular section of the rail but only employs ribs that fit into the rail slots. The ribs are a height to protrude above the upper surface of the rails, thus giving protection to the rail and a very low profile gripping area.

The ideal material would be a synthetic rubber, but the design of the grip covers would also allow for use of other materials, such as polyurethanes, silicones, elastomers, vinyls, and even more rigid material, but not limited to these materials. The ideal design is one that clips over the angular sections of the rail and is retained by the spring actions of the material used, aided by the rigidity enhancing design elements of the ribs and increasing surface area that must be flexed to remove the covers, but not limited to this. Other means of accomplishing this are to employ a small diameter pin that that fits through the covers from side to side. The retaining pin would be removed for installation, the cover to be clipped onto the rail. Once on, the pin would be inserted into a pre-formed hole that ran from side to side and actually went through one or more of the slot ribs, thereby locking the cover on. Another means of attaching would be to employ a large flat spring clip that could be snapped into nesting points on the outside of the cover on either edge once the covers were clipped onto the rail. The spring clip would nest into a trough formed into the cover at manufacture and be flat with the surface, there by locking the covers into place. These are two additional means of mechanically enhancing the retaining characteristics of the grip materials but are not limited to them.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
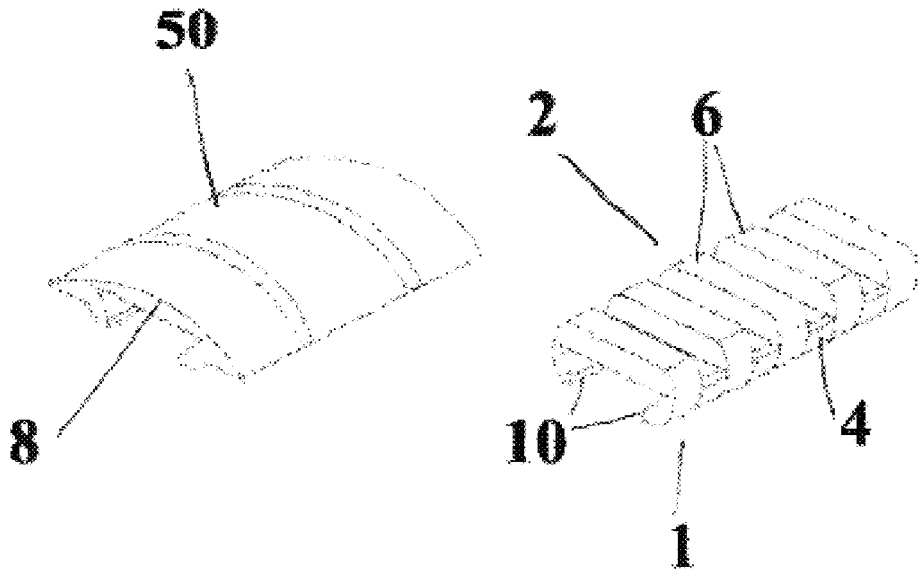
FIG. 1 is a perspective view of the preferred embodiment of the invention, taken from the bottom of the invention.
Figure 2:
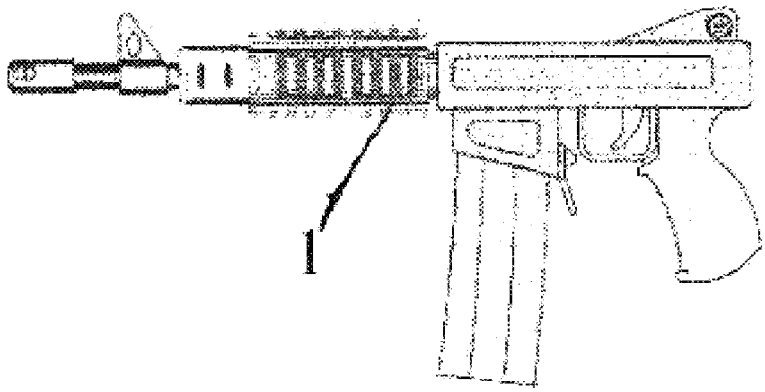
FIG. 2 is a side elevation of a standard M-16/AR-15 rifle with a mounting rail having the invention installed.
Figure 3:
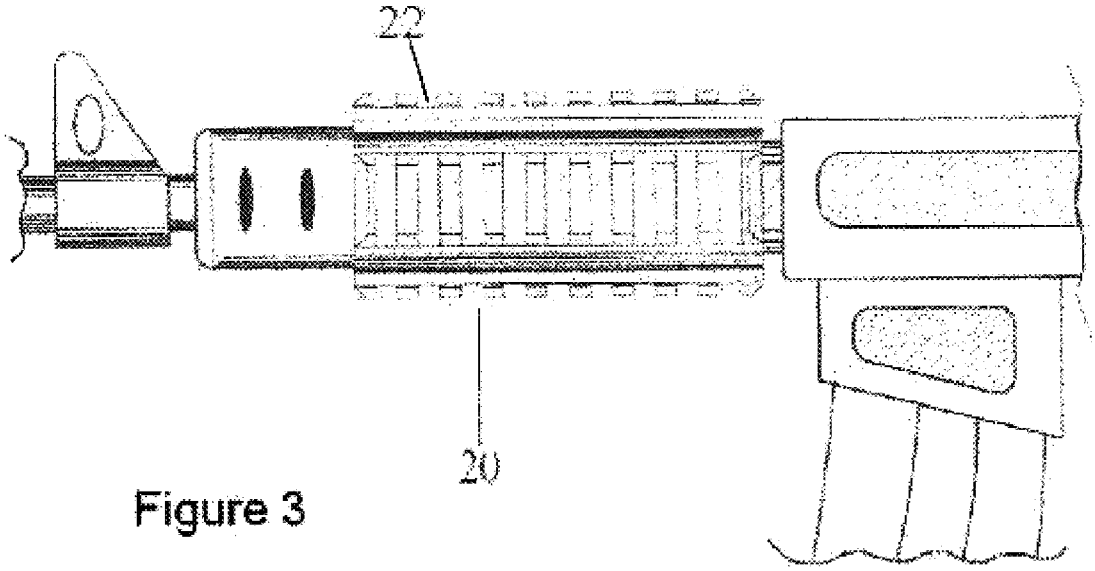
FIG. 3 is a close up view of the rail of the rifle of FIG. 2.
Figure 4:
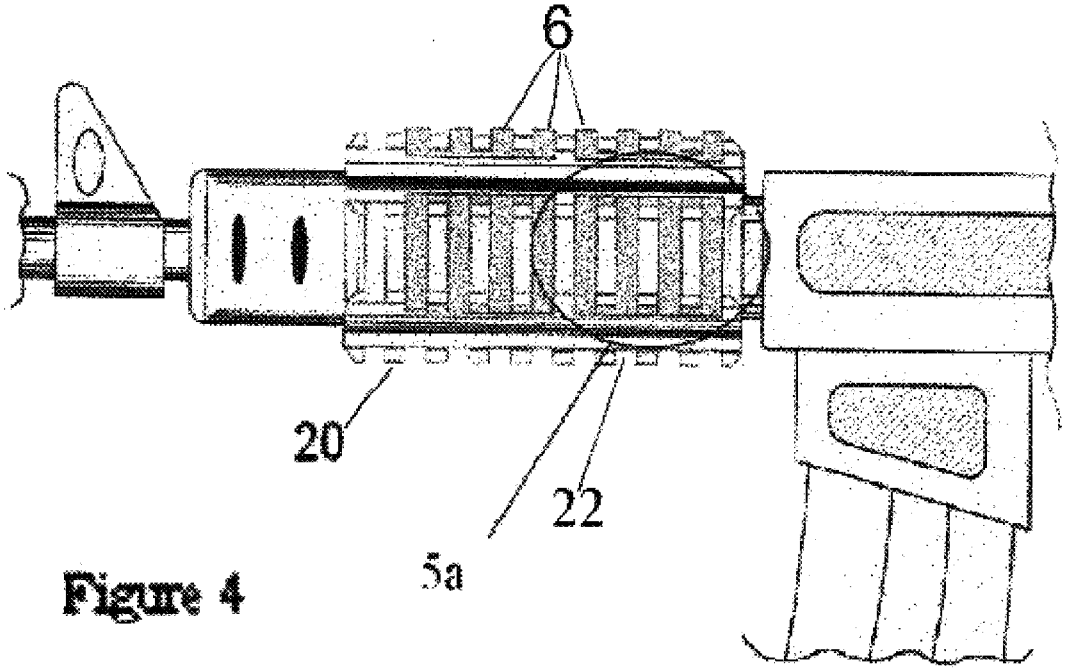
FIG. 4 is a close up view of the rail of FIG. 3 without the invention installed.
Figure 5A:
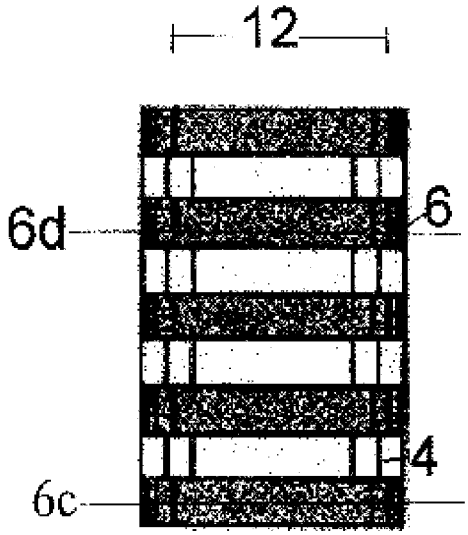
FIGS. 5*a* and 5*b* are top plan views of the two preferred embodiments of the invention.
Figure 5B:
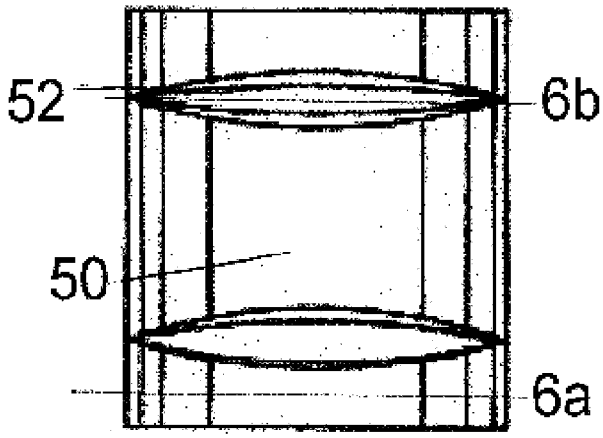
Figure 6A:
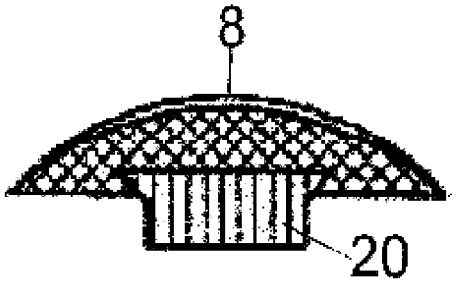
FIGS. 6*a–d* are cross-sectional views of the covers in FIGS. 5*a* and 5*b* installed on a rail along the referenced lines of the preferred embodiment of the invention.
Figure 6B:
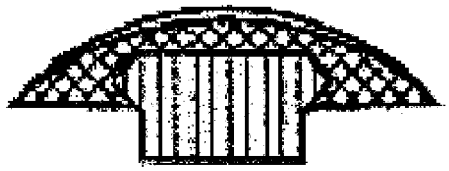
Figure 6C:
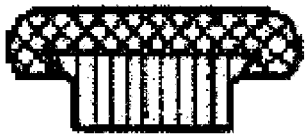
Figure 6D:
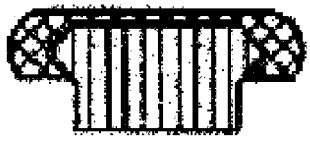

With reference now to the drawings, the preferred embodiment of the rail cover according to the present invention is herein described. As can be seen in FIG. 1, the cover 1 has a cover body 2 comprised of two clip bars 4 connected together in a parallel relationship by a plurality of ribs 6. The ribs 6 are formed with a curvature 8, thereby giving curvature to the entire cover body 2. Clip bars 4 each have a clip side 10 that curves against the curvature 8 and, when in use, into the rifle rail 20, as shown in FIGS. 6*a–d*. Affixing clip bars 4 onto rail 20, by inserting the clip bars 4 underneath the rail 20, stretches the cover body 2 in a manner against the curvature 8 of the cover. The resultant strain in the cover body 2 provides the gripping force required to retain the cover 1 on the rail 20. In practice, any resilient material may be used to make the cover 1, however synthetic rubbers and plastics tend to work best. Measurements of the cover will be dictated by the size of the rail, but in any event the distance between the two clip bars 12, FIG. 5*a*, should be less than the width of a desired rail but should not be so small as to prevent the cover body 2 from fitting over the rail 20 when the body is flattened.

The advantages of ribs 6 are that they can be made to nest in the transverse slots 22 of the rail 20, thereby reducing longitudinal motion along the rail 20. A second advantage of ribs 6 is that they provide a low profile, positive gripping surface, even on solid rails. This positive surface is not negated by moisture, unlike the smooth surface used in the prior art.

Figure 7A:
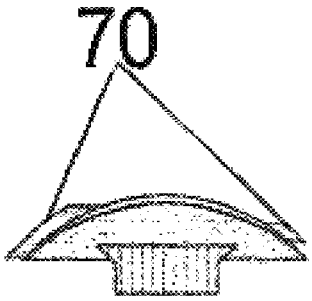
FIGS. 7*a* and 7*b* are a top plan and a front elevation of the cover according to the present invention with an inserted reinforcement beam.
Figure 7B:
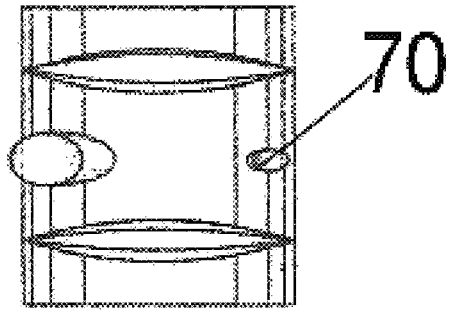

Several alternatives to the preferred embodiment may be envisioned. The first alternative is to use a solid cover body 50 as opposed to ribs 6, shown in FIGS. 5*a*, 6*a*, and 6*b*. Ribs or grooves 52 may be added to the solid cover body 50 through conventional molding technology. A second alternative is to add a reinforcing beam 70, shown in FIG. 7*a*. Beam 70 may be a fixed structure, molded in one piece with the cover. Alternatively, it may be a separate pin that may be inserted into the clip bars 4 through one of the transverse slots 22 of the rail 20.

Although the present invention has been described with reference to preferred embodiments, numerous modifications and variations can be made and still the result will come within the scope of the invention. No limitation with respect to the specific embodiments disclosed herein is intended or should be inferred.

I claim:

1. For a mounting rail having a uniform width, a rail cover comprising:

a. two mounting clips disposed in a parallel relationship to one another;

b. a resilient cover body spanning between the two clips; and c. at least one locating means located between the two mounting clips wherein, a normal distance between the two clips is less than a distance between the two clips when the cover body is flexed.

2. The rail cover of claim 1, wherein a material from which the cover is manufactured is selected from the group consisting of: natural rubber, synthetic rubber, plastic, resin, vinyl, polyurethane, silicone, neoprene, and metal.

3. The rail cover of claim 2, the cover body having a curvature opposite to a curvature of the clips.

4. The rail cover of claim 3, the locating means being a plurality of ribs perpendicular to the clips.

5. The rail cover of claim 4, wherein the plurality of ribs are uniformly spaced apart.

6. The rail cover of claim 5, wherein the cover body is solely comprised of the plurality of ribs.

7. The rail cover of claim 3, the cover body being comprised of a solid body.

8. The rail cover of claim 7, the cover body being further comprised of at least one friction groove.

9. The rail cover of claim 2, the locating means being a plurality of ribs perpendicular to the clips.

10. The rail cover of claim 9, wherein the plurality of ribs are uniformly spaced apart.

11. The rail cover of claim 10, wherein the cover body is solely comprised of the plurality of ribs.

12. The rail cover of claim 2, the cover body being comprised of a solid body.

13. The rail cover of claim 12, the cover body being further comprised of at least one friction groove.

14. The rail cover of claim 2, further comprising a transverse restraining beam further connecting the two parallel clips.

15. The rail cover of claim 14, the locating means being a plurality of ribs perpendicular to the clips.

16. The rail cover of claim 15, wherein the plurality of ribs are uniformly spaced apart.

17. The rail cover of claim 16, wherein the cover body is solely comprised of the plurality of ribs.

18. The rail cover of claim 14, the cover body being comprised of a solid body.

19. The rail cover of claim 18, the cover body being further comprised of at least one friction groove.

20. The rail cover of claim 14, wherein the restraining beam is a separate piece, insertable through the clips.

21. The rail cover of claim 20, the locating means being a plurality of ribs perpendicular to the clips.

22. The rail cover of claim 21, wherein the plurality of ribs are uniformly spaced apart.

23. The rail cover of claim 22, wherein the cover body is solely comprised of the plurality of ribs.

24. The rail cover of claim 20, the cover body being comprised of a solid body.

25. The rail cover of claim 24, the cover body being further comprised of at least one friction groove.

26. The rail cover of claim 1, the locating means being a plurality of ribs perpendicular to the clips.

27. The rail cover of claim 26, wherein the plurality of ribs are uniformly spaced apart.

28. The rail cover of claim 27, wherein the cover body is solely comprised of the plurality of ribs.

29. The rail cover of claim 26, the cover body being comprised of a solid body.

30. The rail cover of claim 29, the cover body being further comprised of at least one friction groove.

* * * * *

US006725594C1

(12) EX PARTE REEXAMINATION CERTIFICATE (10574th)

United States Patent

Hines

(10) Number: US 6,725,594 C1

(45) Certificate Issued: Apr. 24, 2015

(54) RAIL COVER FOR FIREARM RAIL SYSTEMS

(75) Inventor: Stephen Charles Hines, Tijeras, NM (US)

(73) Assignee: FALCON INDUSTRIES, INC., Edgewood, NM (US)

Reexamination Request:
No. 90/013,197, May 1, 2014

Reexamination Certificate for:

| | |
|---|---|
| Patent No.: | **6,725,594** |
| Issued: | **Apr. 27, 2004** |
| Appl. No.: | **10/288,354** |
| Filed: | **Nov. 4, 2002** |

Related U.S. Application Data

(60) Provisional application No. 60/337,475, filed on Nov. 4, 2001.

(51) Int. Cl.
*F41A 35/02* (2006.01)
*F41G 11/00* (2006.01)

(52) U.S. Cl.
CPC ..... *F41A 35/02* (2013.01); *F41G 11/003* (2013.01)

(58) Field of Classification Search
CPC ..... F41A 35/02; F41G 11/003
USPC ..... 42/90, 96, 124, 143, 111, 112, 125; 206/3, 221; 220/784, 788, 790
See application file for complete search history.

(56) References Cited

To view the complete listing of prior art documents cited during the proceeding for Reexamination Control Number 90/013,197, please refer to the USPTO's public Patent Application Information Retrieval (PAIR) system under the Display References tab.

*Primary Examiner* — Russell Stormer

(57) ABSTRACT

The disclosed invention is a rail cover for use on mounting rails typically, though not exclusively, used on personal firearms. The covers may be made to fit either Picatinny or Weaver type rails and feature a clipping structure on the cover's underside that grasps the rail while the tension in the cover body holds the cover in place. Two preferred embodiments disclose a solid cover and a low profile, ribbed cover that nests within transverse grooves in some rails. Alternatively, a restraining beam may be utilized to further restrain the clipping structure and retain the cover on the rail.

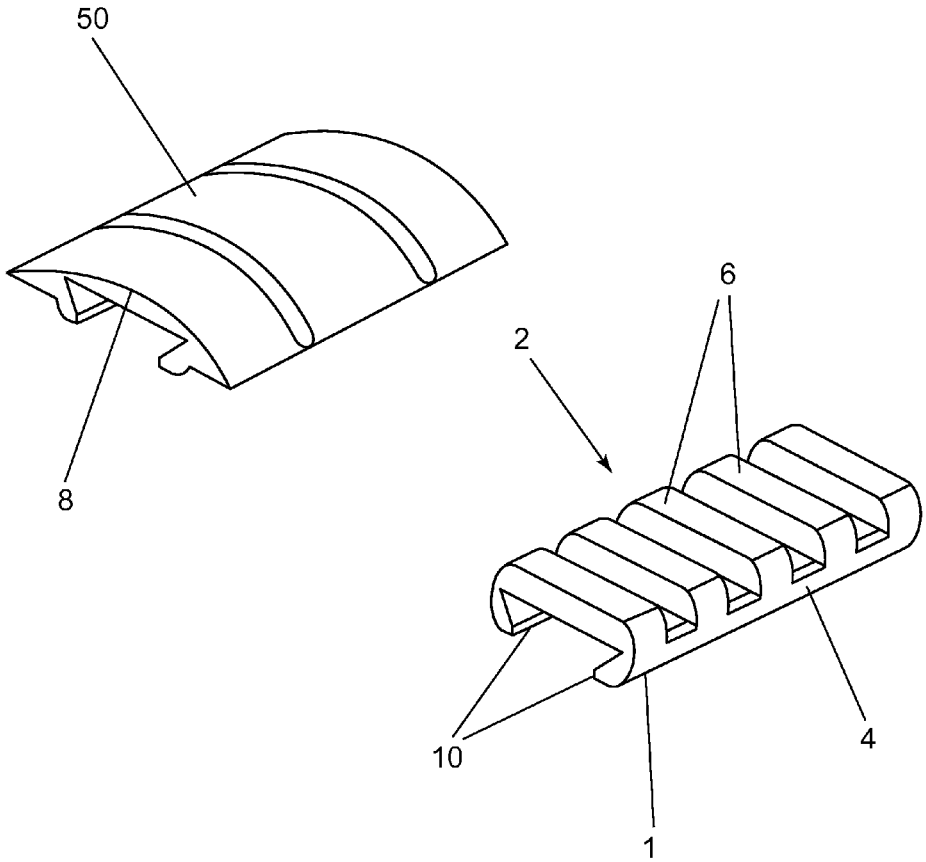

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4-13, 15-25, 29 and 30 are cancelled.

Claims 1 and 26 are determined to be patentable as amended.

Claims 2, 3, 14, 27 and 28, dependent on an amended claim, are determined to be patentable.

New claims 31-41 are added and determined to be patentable.

1. For a mounting rail having a uniform width, a rail cover comprising:

a. two mounting clips disposed in a parallel relationship to one another;

b. a resilient cover body spanning between the two clips; and c. at least one locating means located between the two mounting clips wherein, a normal distance between the two clips is less than a distance between the two clips when the cover body is flexed*;*

*wherein the locating means is a plurality of ribs perpendicular to the clips;*

*wherein the plurality of ribs are uniformly spaced apart;*

*wherein the cover body is solely comprised of the plurality of ribs*.

26. [The rail cover of claim 1,] *For a mounting rail having a uniform width, a rail cover comprising:*

*a. two mounting clips disposed in a parallel relationship to one another;*

*b. a resilient cover body spanning between the two clips; and*

*c. at least one locating means located between the two mounting clips wherein, a normal distance between the two clips is less than a distance between the two clips when the cover body is flexed,* the locating means being [a plurality of] *at least three* ribs perpendicular to the clips.

*31. A rail cover for a mounting rail wherein a firearm comprises the mounting rail, wherein the mounting rail has a length, a width, and comprises a plurality of transverse slots and recoil abutments, the rail cover comprising:*

*a resilient material that provides for clipping the rail cover onto the mounting rail wherein a single piece of the resilient material forms the entire rail cover;*

*a clipping structure that grasps the mounting rail while tension in the rail cover holds the cover in place; and*

*one or more ribs that nest into the transverse slots and prevent the rail cover from moving forward or backward on the mounting rail, wherein the rail cover protects a section of the mounting rail that is not in use for mounting an optic, a vertical grip, or a laser to the firearm.*

*32. The rail cover of claim 31 wherein the clipping structure comprises two clip bars connected together in a parallel relationship wherein the clip bars are separated by a distance that is less than the width of the mounting rail.*

*33. The rail cover of claim 32 wherein the one or more ribs are a plurality of ribs comprising at least three ribs, and wherein the clip bars are connected together solely by the ribs.*

*34. The rail cover of claim 31 further comprising a solid body that covers a plurality of the recoil abutments.*

*35. The rail cover of claim 31 wherein the rail cover protects a plurality of the transverse slots and the related recoil abutments.*

*36. The rail cover of claim 31 wherein the rail cover protects at least five of the transverse slots and the related recoil abutments.*

*37. A rail cover for a mounting rail wherein a firearm comprises the mounting rail wherein the mounting rail has a length, a width, and comprises a plurality of transverse slots and recoil abutments, the rail cover comprising:*

*a resilient material that provides for clipping the rail cover onto the mounting rail wherein a single piece of the resilient material forms the entire rail cover;*

*two clip bars connected together in a parallel relationship wherein the clip bars are separated by a distance that is less than the width of the mounting rail, wherein the clip bars retain the rail cover on the mounting rail;*

*one or more ribs that nest into the transverse slots and prevent the rail cover from moving forward or backward on the mounting rail, wherein the rail cover protects a section of the mounting rail that is not in use for mounting an optic, a vertical grip, or a laser to the firearm.*

*38. The rail cover of claim 37 wherein the one or more ribs are a plurality of ribs comprising at least three ribs, and wherein the clip bars are connected together solely by the ribs.*

*39. The rail cover of claim 37 further comprising a solid body that covers a plurality of the recoil abutments.*

*40. The rail cover of claim 37 wherein the rail cover protects a plurality of the transverse slots and the related recoil abutments.*

*41. The rail cover of claim 37 wherein the rail cover protects at least five of the transverse slots and the related recoil abutments.*

* * * * *